US005431783A

United States Patent [19]

Honig

[11] Patent Number: 5,431,783

[45] Date of Patent: Jul. 11, 1995

[54] COMPOSITIONS AND METHODS FOR IMPROVING PERFORMANCE DURING SEPARATION OF SOLIDS FROM LIQUID PARTICULATE DISPERSIONS

[75] Inventor: Dan S. Honig, New Canaan, Conn.

[73] Assignee: Cytec Technology Corp., Wilmington, Del.

[21] Appl. No.: 92,859

[22] Filed: Jul. 19, 1993

[51] Int. Cl.[6] ..... D21H 17/72

[52] U.S. Cl. ..... 162/164.1; 162/164.6; 162/168.2; 162/168.3; 162/183

[58] Field of Search ..... 162/168.2, 168.3, 164.6, 162/183, 164.1

[56] References Cited

U.S. PATENT DOCUMENTS

| | | | |
|---|---|---|---|
| 3,294,723 | 12/1966 | Goldstein et al. | 260/29.2 |
| 3,348,997 | 10/1967 | Lagally et al. | 162/164 |
| 3,350,340 | 10/1967 | Soenksen et al. | 260/29.6 |
| 3,520,774 | 7/1970 | Roth | 162/164 |
| 3,617,440 | 11/1971 | Strother, Jr. | 162/168 |
| 3,635,842 | 1/1972 | Longoria, III et al. | 260/2 BP |
| 3,642,572 | 2/1972 | Endres et al. | 162/164 |
| 3,679,621 | 7/1972 | Morf et al. | 260/29.6 H |
| 4,021,364 | 5/1977 | Speiser et al. | 252/316 |
| 4,144,123 | 3/1979 | Scharf et al. | 162/164 R |
| 4,305,781 | 12/1981 | Langley et al. | 162/164 R |
| 4,328,142 | 5/1982 | Hertel et al. | 523/417 |
| 4,385,165 | 5/1983 | Ahne et al. | 528/53 |
| 4,388,150 | 6/1983 | Sunden et al. | 162/175 |
| 4,521,317 | 6/1985 | Candau et al. | 252/8.55 D |
| 4,643,801 | 2/1987 | Johnson | 162/164.1 |
| 4,681,912 | 7/1987 | Durand et al. | 524/827 |
| 4,749,444 | 6/1988 | Lorz et al. | 162/183 |
| 4,750,974 | 6/1988 | Johnson | 162/164.1 |
| 4,753,710 | 6/1988 | Langley et al. | 162/164.3 |
| 4,798,653 | 1/1989 | Rushmere | 162/168.3 |
| 4,965,640 | 9/1990 | Kozakiewicz et al. | 523/223 |
| 5,167,766 | 12/1992 | Honig et al. | 162/164.1 |
| 5,171,808 | 12/1992 | Ryles et al. | 526/264 |
| 5,180,473 | 1/1993 | Akune et al. | 162/168.2 |

FOREIGN PATENT DOCUMENTS

| | | | |
|---|---|---|---|
| 0202780 | 4/1986 | European Pat. Off. | C02F 1/56 |
| 0462365A1 | 3/1991 | European Pat. Off. . | |
| 67735 | 1/1985 | Finland . | |
| 67736 | 1/1985 | Finland | D21H 3/58 |
| 1443777 | 5/1966 | France . | |
| 63-235596 | 7/1988 | Japan | D21H 3/38 |

OTHER PUBLICATIONS

*Pulp & Paper*, 51 (Jul., 1977) 8, "Microbeads—A Novel Approach To Retention Aids and Flocculation".

Huang et al, *Macromolecular Chemistry* 186, 273–281 (1985).

Fukatomi et al. *J. Appl. Polymer Sci.* 44, 737–741 (1992).

Kawaguchi et al., *Polymer Int'l* 30, 225–231 (1993).

Stoffer and Bone, *J. Dispersion Sci. and Tech.*, 1(1), 37, 1980.

Atik and Thomas, *J. Am. Chem. Soc.*, 103 (14), 4279 (1981).

*Primary Examiner*—Peter Chin

*Attorney, Agent, or Firm*—Frank M. Van Riet

[57] ABSTRACT

A method for providing improved liquid-solid separation performance in liquid particulate dispersion systems. The method comprising adding to a liquid system containing a plurality of finely divided particles (i) from about 0.05 to about 10 pounds per ton, based upon the dry weight of the particles, of an ionic, organic cross-linked polymeric microbead with a diameter of less than about 500 nm, and (ii) from about 0.05 to about 20 pounds per ton, same basis, of a polymeric material selected from the group consisting of polyethylenimines, modified polyethylenimines and mixtures thereof. In addition to the compositions described above, additives such as organic ionic polysaccharides (e.g., a starch), may also be combined with the liquid system to facilitate separation of the particulate material therefrom.

10 Claims, No Drawings

COMPOSITIONS AND METHODS FOR IMPROVING PERFORMANCE DURING SEPARATION OF SOLIDS FROM LIQUID PARTICULATE DISPERSIONS

TECHNICAL FIELD

The present invention relates generally to compositions and methods for providing improved liquid-solid separation performance in papermaking processes, as well as in other processes involving the separation of solids from liquid particulate dispersions. More particularly the invention relates to the addition of modified and/or unmodified polyethylenimine ("PEI") and charged organic polymer microbeads to papermaking systems comprising liquid dispersions of cellulosic fibers for improving drainage, retention and formation in such systems.

BACKGROUND OF THE INVENTION

Papermaking processes require treatment of a system comprising a liquid dispersion of solid particles for separating the solids therefrom. Fast drainage and greater retention of fines contribute to lower costs in papermaking and thus improvements in this ares are always being sought. Improvements in formation are likewise desired as such improvements result in a better product. One method for improving these properties, which was first practiced during the 1980's, involves the use of colloidal silica and bentonite. The improved drainage offered with the use of these materials, i.e., as indicated by increasing speed and efficiency with greater retention of fines, provides significant cost savings over the prior art techniques.

U.S. Pat. Nos. 4,385,165 and 4,388,150 describe a two-component binder system comprising a cationic starch and an anionic, colloidal silicic acid sol which acts as a retention aid when combined with cellulose fibers in a paper-making stock. Finnish published specification Nos. 67,735 and 67,736 disclose cationic polymer retention agent compounds comprising cationic starch and polyacrylamide. These materials are described by the subject references as being useful when combined with an anionic silica in improving sizing.

U.S. Pat. No. 4,798,653 discloses the use of cationic colloidal silica sol in combination with an anionic copolymer of acrylic acid and acrylamide for rendering paper stock resistant to loss of its retention and dewatering properties due to shear forces attributable to the papermaking process.

A coacervate binder, three-component system composed of a cationic starch, an anionic high molecular weight polymer and dispersed silica having a particle diameter range from 1 to 50 nm is described in U.S. Pat. Nos. 4,643,801 and 4,750,974.

The two Finnish patent publications noted above additionally describe the use of bentonite with cationic starch and polyacrylamides ("PAMs"). Further, U.S. Pat. No. 4,305,781 discloses a bentonite-type clay used in combination with high-molecular weight, substantially non-ionic polymers such as polyethylene oxides and PAMs for use as retention agents. U.S. Pat. No. 4,753,710 discloses the use of bentonite with a substantially linear, cationic polymer, e.g., cationic acrylic polymers, polyethylene imine, polyamine epichlorohydrin and dialkyl dimethyl ammonium chloride as providing an improved combination of retention, drainage, drying and formation.

Another material which has been found useful in separating particulate dispersions of the type contemplated herein is organic crosslinked microbeads. Such microbeads are known to be particularly useful for flocculating a wide variety of dispersions of suspended solids as described for example in U.S. Pat. No. 5,171,808.

The use of such organic crosslinked microbeads in papermaking is taught, e.g., in U.S. Pat. No. 5,180,473. The '473 reference discloses a dual system comprising a cationic organic microbead of 1–100 microns together with an anionic, cationic or nonionic acrylamide polymer. The cationic polymer particle is of the water swelling type and is a crosslinked homopolymer of 2-methacryloyloxyethyl trimethylammonium chloride or a crosslinked copolymer of 2-methacryloxy-ethyl trimethylammonium chloride/acrylamide (60/40 weight percent). The acrylamide polymer is an acrylamide homopolymer or acrylamide hydrolysate of 17 mole percent anion-conversion or a copolymer of acrylamide/2-methacryloyloxyethyltrimethyl ammonium chloride (75/25 weight percent). Japanese Patent Publication No. JP 235596/63:1988, which corresponds to the U.S. '473 patent, discloses the use of both cationic and anionic microbeads. The anionic microbead disclosed by the Japanese reference is an acrylamide-acrylic acid copolymer.

European Patent No. 0 202 780 describes the preparation of cross-linked cationic polyacrylamide beads by conventional inverse emulsion polymerization techniques. During formation of the beads, the PAM is crosslinked by incorporating a difunctional monomer, such as methylene bis-acrylamide, in a manner well known in the art into the polymer chain. The reference further discloses that the cross-linked beads, while useful as flocculants, are more highly efficient after having been subjected to unusual levels of shearing action in order to render them water soluble.

Typically, the particle size of polymers prepared by conventional, inverse, water-in-oil emulsion polymerization processes is limited to the 1–5 micron range since there is no particular advantage known to reduce this particle size. The particle size achievable in inverse emulsions is determinable by the concentration and activity of the surfactants employed, which surfactants are customarily chosen based on the desired emulsion stability as well as on economic factors.

U.S. Pat. No. 5,167,766 discloses the addition, in a papermaking process, of ionic, organic microbeads of up to about 750 nm in diameter to obtain improved drainage, retention and formation. These microbeads may be made as microemulsions, or as microgels, or they may be obtained commercially as microlatices. The microbeads may be added either alone or in combination with a high molecular weight polymer and/or a polysaccharide. Other standard paper-making additives, including particularly alum or any other active, soluble aluminum species, also may be added for their well known purposes.

In view of the importance to, for example, the papermaking industry, of improving drainage, retention and formation during the separation of solid particles from liquid particulate dispersions, those working in this field are constantly on the lookout for compositions and methods which are particularly efficient in improving these properties.

SUMMARY OF THE INVENTION

The present invention is therefore directed to compositions and methods useful in providing improved liquid-solid separation performance in papermaking systems comprising dispersions of cellulosic fibers within an aqueous liquid furnish as evidenced by improvements in drainage, formation and retention parameters within such systems. The invention is, moreover, not limited solely to use in papermaking. It also is useful in a wide variety of other liquid-solid separation processes involving liquid dispersion systems, such systems being defined herein as liquid systems containing finely divided solid particles, which particles, upon treatment with the compositions of the invention by the methods set forth herein, are agglomerated for removal from the liquid system. An example of such a system, i.e., in a field other than papermaking, is the treatment of waste water streams wherein the compositions of the present invention may be added to assist in flocculating, and therefore removing, solids therefrom. A variety of additional examples of such systems are well known in the art. However, for purposes of convenience, the invention is described herein particularly with reference to its use in a papermaking process.

Accordingly, therefore, in the formation of paper from an aqueous suspension of cellulosic papermaking fibers, the improvements described herein are achieved by the addition to the suspension of: (1) crosslinked, ionic, polymeric microbeads less than about 500 nm in diameter and (2) an ethyleneimine polymer or, more preferably, a modified polyethylenimine. Moreover, if desired, the PEI added to the liquid system may be a mixture of modified and unmodified PEI.

As noted above, the present invention includes the use of both "polyethylenimine" and "modified polyethylenimine" materials or mixtures thereof.

Modified polyethylenimines are, for example, polyethylenimines or ethylenimine-modified polyamidoamines whose molecular weights have been increased by crosslinking. These crosslinking reactions, carried out in aqueous solution, are not allowed to proceed to gelation. That is, they do not form an infinitely crosslinked structure and thus a gelled material is not produced. Applicable crosslinkers are epichlorohydrin, polyvinyl alcohol and epichlorohydrin, polyalkylene oxide-epichlorohydrin reaction products, epichlorohydrin or dichlorohydrin reaction products with di-secondary amine, epoxy monomers, as well as other reactants cited in U.S. Pat. Nos. 3,294,723; 3,348,997; 3,350,340; 3,520,774; 3,635,842; 3,642,572; 4,144,123 and 4,328,142; and page 362 of "Ethylenimine and Other Aziridines" by O. C. Dermer and G. E. Ham, (1969). Other modifications include reaction of the polyethylenimines with urea (see, e.g., U.S. Pat. No. 3,617,440), quaternization thereof (p. 362 of Dermer & Ham), and condensation reactions thereof of polyacrylic acid and alkenylamines (see, e.g., U.S. Pat. No. 3,679,621).

Both the modified and the unmodified materials are well known in the art and they are, in addition, both readily available on the commercial market. Thus they need not be further defined herein. For convenience, however, unless otherwise indicated hereinafter, the terms "polyethylenimine" or "PEI" as used herein includes polyethylenimines per se, as well as modified polyethylenimines, and mixtures of modified and unmodified materials.

In preparing the microbeads for use with the invention it was surprisingly found that crosslinked, organic polymeric microbeads such as those described above have a high efficiency as retention and drainage aids when their particle size is kept to less than about 500 nm in diameter and preferably less than about 300 nm in diameter, with the most preferred diameter being between about 25–300 nm. Moreover, as demonstrated in the Examples provided herewith, the addition of such microbeads in combination with, specifically, ethyleneimine polymers (whether modified, unmodified or both), provides substantial improvements in e.g., drainage time, in systems in which the subject materials have been added.

One embodiment of the present invention comprises adding to a particulate suspension, e.g., of cellulosic papermaking fibers, from about 0.05 to 20 pounds per ton of organic microbeads, i.e., of a diameter as described above, and from about 0.05 to about 20 pounds per ton, preferably about 0.1 to 5 pounds per ton, of ionic PEI. The pounds/ton of the materials used is based on the dry weight of the solids in solution.

The microbeads used in the method of the invention may be made as microemulsions by a process employing an aqueous solution comprising a cationic, or preferably an anionic, monomer and a crosslinking agent; an oil comprising a saturated hydrocarbon and an effective amount of a surfactant sufficient to produce particles of less than about 0.5 micron in particle size diameter. Polymerization of the emulsion may be accomplished by the addition of a polymerization initiator, or by subjecting the emulsion to ultraviolet radiation. In addition, an effective amount of a chain transfer agent may be added to the aqueous solution of the emulsion to control the polymerization.

The microbeads may also be made as microgels by procedures described by Huang et al., *Macromolecular Chemistry* 186, 273–281 (1985); Fukatomi et al., *J. Appl. Polymer Sci.* 44, 737–741 (1992) and Kawaguchi et al., *Polymer Int'l.* 30, 225–231 (1993), or they may be obtained commercially as microlatices. The term "microbead" as used herein includes all of these configurations, i.e., beads, microgels and microlatices.

In a preferred embodiment of the invention, anionic microbeads are added with cationic PEI. Alternatively, however, the invention also contemplates the addition of cationic beads with the PEI.

DETAILED DESCRIPTION OF THE PREFERRED EMBODIMENTS

As noted above, addition of the materials described herein, namely: (1) ionic, organic, crosslinked polymeric microbeads having a diameter of less than about 500 nm and (2) PEI, to a liquid dispersion of cellulosic fibers within a papermaking system according to the invention will result in improved drainage and formation as well as greater fines and filler retention values. Moreover, as also noted, these materials are additionally useful in a variety of other liquid-solid separation techniques, such as in the removal by flocculation of particulates from waste water streams e.g. sludge dewatering.

In one embodiment of the invention, only the microbeads and the PEI are added to the dispersion, while in an alternate embodiment the PEI and microbeads are added in conjunction with one or more additives (as discussed below), to a conventional papermaking stock such as traditional chemical pulps, e.g., bleached and unbleached sulphate or sulphite pulp, mechanical pulp such as groundwood, thermomechanical or chemi-thermomechanical pulp or recycled pulp such as old corrugated containers, newsprint, office waste, magazine paper and other non-deinked waste, deinked waste and mixtures thereof. The stock and final paper can be substantially unfilled or filled with amounts of up to 50%, based upon the dry weight of the stock, or up to about 40%, based upon the dry weight of paper in the filler, being exemplary.

When a filler is used, any conventional filler, such as calcium carbonate, clay, titanium dioxide, talc, or a combination thereof may be present. The filler, if present, may be incorporated into the stock either before or after the addition of the microbeads and the PEI.

As noted above, a wide variety of standard papermaking additives may also be added to the dispersion for their usual purposes. These additives include rosin sizing, synthetic sizings such as alkyl succinic anhydride and alkyl ketene dimer, alum or any other active soluble aluminum species such as polyhydroxy aluminum chloride and/or sulfate, sodium aluminate and mixtures thereof, strength additives, promoters, polymeric coagulants such as low molecular weight polymers, i.e., having a molecular weight less than or equal to 100,000, dye fixatives, and other materials that are useful in the papermaking process as would be well known in the art. The order of addition, specific addition points, and furnish modification itself are not critical. Rather, these considerations are based upon practicality and performance for each specific application.

In the process of the invention the preferred sequence of addition is to add the PEI first, followed by the microbeads. As noted above, the preferred embodiment of the invention utilizes cationic PEI and anionic microbeads, although use of the polymer with cationic microbeads will also provide acceptable results and is considered within the scope of the present invention.

In a further embodiment of the invention, in addition to the PEI and microbeads described above, a third component is added to the particulate dispersion, namely from about 1 to 50, preferably about 5 to 30, pounds per ton, of an organic polysaccharide, such as a starch, said polysaccharide preferably having a charge opposite to that of the microbead, In instances involving the addition of a cationic polysaccharide and cationic PEI, these materials can be added separately or together, and in any order. Furthermore, these materials may be individually added at more than one point. The anionic microbeads may be added before any cationic components, or alternately after them, with the latter being the preferred method. If desired, split addition may also be practiced.

In summary, therefore, the addition points utilized in the method of the invention are those typically used with dual retention and drainage systems (pre-fan pump or pre-screen for one component and pre- or post-screens for another). However, adding the last component before the fan pump may be warranted in some cases. Other addition points that are practical can be used if better performance or convenience is obtained. Thick stock addition of one component is also possible, although thin stock addition is preferred. Thick stock and/or split thick and thin stock addition of cationic starch are further alternatives. These addition modes are applicable for the microbeads as well. Addition points may be determined by practicality and by the need to place more or less shear on the treated system to ensure good formation.

The degree of substitution of cationic starches (or other polysaccharides) and other non-synthetic based polymers may be from about 0.01 to about 1.0, preferably from about 0.02 to about 0.2. Amphoteric starches, preferably but not exclusively with a net cationic starch, may also be used. The degree of substitution of anionic starches (or other polysaccharides) and other non-synthetic-based polymers may be from about 0.01 to about 0.7 or greater.

The ionic starch may be made from starches derived from any of the common starch-producing materials, e.g., potato starch, corn starch, waxy maize, etc. For example, a cationic potato starch may be made by treating potato starch with 3-chloro-2-hydroxypropyl trimethylammonium chloride. Mixtures of synthetic polymers and, e.g., starches, may be used. Other polysaccharides useful herein include guar, cellulose derivatives such as carboxymethylcellulose and the like.

The preferred PEIs are modified polyethylenimines manufactured and sold by BASF under the trade names Polymin SK and Polymin SN. These materials are preferred mainly due to the fact that they are readily available in commercial quantities at reasonable prices. However, PEIs and modified PEIs supplied by other manufacturers will also work in the invention and are thus also contemplated for use therein. Some commercially available PEI's are listed in Table 2 (p. 336) of "Polyethylenimine-Physiochemical Properties and Applications", by D. Horn in "IUPAC International Symposium on Polymeric Amines and Ammonium Salts" (Ghent, Belgium, September 24–27, 1979). The PEI component of the invention is preferably supplied in a 15–50% solids solution, although concentrations outside of the stated range have also been found to be effective in certain circumstances.

The principal advantage offered by the use of the present invention concerns the fact that the cationic polyacrylamide retention aids typically used in the prior art are commonly supplied as emulsions or powders. Their use thus requires cumbersome and expensive solution make-up equipment. This make-up equipment is not required with the present method due the addition of PEI with the microbeads.

As a further advantage, the addition of the above-described materials eliminates the need for alum or other aluminum salts which are sometimes required in prior art systems, thus reducing both the cost and complexity of the paper forming process. Thus the method of the invention serves both to simplify the separation process and also to significantly reduce the capital expenditure necessary therefor, since one practicing the invention can now dispense with the previously required solution make-up equipment, as well as the alum or other aluminum salts which were otherwise called for in certain prior art methods.

Turning now to a discussion of the microbeads useful in the invention, these materials are crosslinked, ionic (i.e., cationic or anionic), polymeric organic microparticles having an average particle size diameter of about 500 nm or less, preferably less than about 300 nm and most preferably between about 25–300 nm and a crosslinking agent content of above about 4 molar parts per million, based on the monomeric units present in the polymer. More preferably a crosslinking content of from about 4 to about 6,000 molar parts per million is used, most preferably, about 20 to 4,000. The beads are generally formed by the polymerization of at least one ethylenically unsaturated cationic or anionic monomer and, optionally, at least one non-ionic comonomer in the presence of the crosslinking agent. The microbeads preferably have a solution viscosity ("SV") of about 1.1–2 mPa.s.

The anionic microbeads preferred for use herein are those made by hydrolyzing acrylamide polymer microbeads, and those made by polymerizing such monomers as (methyl)acrylic acid and their salts, 2-acrylamide-2-methyl-propane sulfonate, sulfoethyl-(meth)acrylate, vinylsulfonic acid, styrene sulfonic acid, maleic or other dibasic acids or their salts or mixtures thereof.

Nonionic monomers suitable for making microbeads as copolymers with the above anionic and cationic monomers, or mixtures thereof, include (meth)acrylamide; N-alkylacrylamides such as N-methylacrylamide; N,N-dialkylacrylamides such as N,N-dimethylacrylamide, methyl acrylate; methyl methacrylate; acrylonitrile; N-vinyl methylacetamide; N-vinyl methyl formamide; vinyl acetate; N-vinyl pyrrolidone, mixtures of any of the foregoing and the like.

These ethylenically unsaturated, non-ionic monomers may be copolymerized, as mentioned above, to produce cationic, anionic or amphoteric copolymers. Preferably, acrylamide is copolymerized with an ionic and/or a cationic monomer. Cationic or anionic copolymers useful in making the microbeads described herein comprise up to about 99 parts by weight of non-ionic monomer and from about 100 to about 1 part by weight of cationic or anionic monomer, based on the total weight of the anionic or cationic and non-ionic monomers, preferably from about 10 to about 90 parts by weight of non-ionic monomer and about 10 to about 90 parts by weight of cationic or anionic monomer, same basis, i.e., the total ionic charge in the microbead must be greater than about 1%. Mixtures of polymeric microbeads may also be used if the total ionic charge of the mixture is also over about 1%.

Most preferably, the microbeads used in the invention contain from about 20 to 80 parts by weight of non-ionic monomer and about 80 to about 20 parts by weight, same basis, of cationic or anionic monomer or a mixture thereof. Polymerization of the monomers occurs in the presence of a polyfunctional crosslinking agent as noted above to form the crosslinked microbead. Alternatively, the preformed polymer itself may be crosslinked as taught, for example, in U.S. Pat. No. 4,956,400, the disclosure of which is specifically incorporated herein by reference thereto.

Useful polyfunctional crosslinking agents comprise compounds having either at least two double bounds, a double bond and a reactive group, or two reactive groups. Illustrative of those containing at least two double bounds are N,N-methylenebisacrylamide; N,N-methylenebismethacrylamide; polythyleneglocol diacrylate; polyethyleneglycol dimethacrylate; N-vinyl acrylamide; divinylbenzene; triallylammonium salts, N-methylallylacrylamide and the like. Polyfunctional branching agents containing at least one double bond and at least one reactive group include glycidyl acrylate; glycidyl methacrylate; acrolein; methylolacrylamide and the like. Polyfunctional branching agents containing at least two reactive groups include dialdehydes, such as glyoxal; diepoxy compounds; epichlorohydrin and the like.

The less preferred, but still useful cationic microbeads for use in the invention include those made by polymerizing such monomers as diallyldialkylammonium halides; acryloxyalkyltrimethylammonium chloride; (meth)acrylates of dialkylaminoalkyl compounds, and salts and quaternaries thereof and monomers of N,N-diakylaminoalkyl(meth)acrylamides, and salts and quaternaries thereof, such as N,N-dimethyl aminoethylacrylamides; (meth)acrylamidopropyltriethylammonium chloride and the acid or quaternary salts of N,N-dimethylaminoethylacrylate and the like; salts and quaternaries thereof of polyacrylamides formed by chemical reactions on the polyacrylamide (e.g., the mannich reaction of dimethylamine and formaldehyde on polyacrylamide).

Cationic monomers which may be used herein are of the following general formulae:

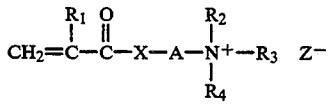

(I)

where $R_1$ is hydrogen or methyl, $R_2$ is hydrogen or a lower alkyl of $C_1$ to $C_4$, $R_3$ and/or $R_4$ are hydrogen, an alkyl of $C_1$ to $C_{12}$, aryl, or hydroxyethyl and $R_2$ and $R_3$ or $R_2$ and $R_4$ can be combined to form a cyclic ring containing one or more hetero atoms, Z is the conjugate base of an acid, X is oxygen or $—NR_1$ wherein $R_1$ is as defined above, and A is an alkaline group of $C_1$ to $C_{12}$; or

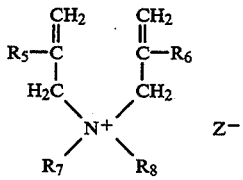

(II)

where $R_5$ and $R_6$ are hydrogen or methyl, $R_7$ is hydrogen or an alkyl of $C_1$ to $C_{12}$, benzyl or hydroxyethyl; and Z is as defined above.

The polymeric microbeads of this invention are preferably prepared by polymerization of the monomers in a microemulsion as disclosed in U.S. Pat. No. 5,171,808 to Harris et al., the disclosure of which is expressly incorporated herein by reference thereto. Polymerization in microemulsions and inverse emulsions may also be used as is known to those skilled in this art. P. Speiser reported in 1976 and 1977 a process for making spherical "nanoparticles" with diameters less than 800Å by: (1) solubilizing monomers, such as acrylamide and methylenebisacrylamide in micelles, and (2) polymerizing the monomers, See *J. Pharm. Sa.*, 65(12), 1763 (1976) and U.S. Pat. No. 4,021,364. Both inverse water-in-oil and oil-in-water "nanoparticles" were prepared by this process. While not specifically called microemulsion polymerization by the author, this process does contain all the features which are currently used to define microemulsion polymerization. These reports also constitute the first examples of polymerization of acrylamide in a microemulsion. Since then, numerous publications reporting polymerization of hydrophobic monomers in the oil phase of microemulsions have appeared. See, for example, U.S. Pat. Nos. 4,521,317 and 4,681,912; Stoffer and Bone, *J. Dispersion Sci. and Tech.*, 1(1), 37, 1980; and Atik and Thomas, *J. Am. Chem. Soc.*, 103 (14), 4279 (1981); and UK patent publication No. GB 2161492A.

The anionic and/or cationic emulsion polymerization process is conducted by: (i) preparing a monomer emulsion by adding an aqueous solution of the monomers to a hydrocarbon liquid containing an appropriate surfactant or surfactant mixture to form an inverse monomer emulsion consisting of small aqueous droplets which, when polymerized, result in polymer particles less than 0.5 micron in size dispersed in the continuous oil phrase and (ii) subjecting the monomer microemulsion to free radical polymerization.

The aqueous phase comprises an aqueous mixture of the anionic and/or cationic monomers and optionally, a non-ionic monomer and the crosslinking agent, as discussed above. The aqueous monomer mixture may also comprise such conventional additives as are desired. For example, the mixture may contain chelating agents to remove polymerization inhibitors, pH adjusters, initiators and other conventional additives.

Essential to the formation of the emulsion, which may be defined as a swollen, transparent and thermodynamically stable emulsion comprising two liquids insoluble in each other and a surfactant, in which the micelles are less than 0.5 micron in diameter, is the selection of an appropriate organic phrase and a surfactant.

The selection of the organic phase has a substantial effect on the minimum surfactant concentration necessary to obtain the inverse emulsion. The organic phase may comprise a hydrocarbon or hydrocarbon mixture. Saturated hydrocarbons or mixtures thereof are the most suitable in order to obtain inexpensive formulations. Typically, the organic phase will comprise benzene, toluene, fuel oil, kerosene, odorless mineral spirits or mixtures of any of the foregoing.

The ratio, by weight, of the amounts of aqueous and hydrocarbon phases is chosen as high as possible, so as to obtain, after polymerization, an emulsion of high polymer content. Practically, this ratio may range, for example, from about 0.5 to about 3:1, and usually approximates 1:1.

The one or more surfactants are selected in order to obtain Hydrophilic Lipophilic Balance ("HLB") values ranging from about 8 to about 11. Outside this range, inverse emulsions are not usually obtained. In addition to the appropriate HLB value, the concentration of surfactant must also be optimized, i.e., sufficient to form an inverse emulsion. Too low a concentration of surfactant leads to inverse emulsions as produced in the prior art and too high a concentration results in undue costs. Typical useful surfactants, in addition to those specifically discussed above, may be anionic, cationic or nonionic and may be selected from polyoxyethylene (20) sorbitan trioleate, sorbitan trioleate, sodium di-2ethylhexylsulfosuccinate, oleamidopropyldimethylamine; sodium isostearyl-2-lactate and the like.

Polymerization of the emulsion may be carried out in any manner known to those skilled in the art. Initiation may be effected with a variety of thermal and redox free-radical initiators including azo compounds, such as azobisisobutyronitrile; peroxides, such as t-butyl peroxide; organic compounds, such as potassium persulfate and redox couples, such as ferrous ammonium sulfate/ammonium persulfate. Polymerization may also be effected by photochemical irradiation processes, irradiation, or by ionizing radiation with a $^{60}Co$ source. Preparation of an aqueous product from the emulsion may be effected by inversion by adding it to water which may contain a surfactant. Optionally, the polymer may be recovered from the emulsion by stripping or by adding the emulsion to a solvent which precipitates the polymer, e.g., isopropanol, filtering off the resultant solids, drying and redispersing in water.

The instant invention also relates to compositions of matter comprising mixtures of the above-described ionic microbeads, PEI and, optionally, at least one polysaccharide. More particularly, these compositions comprise a mixture of A) an ionic, organic, polymer crosslinked microbead with a diameter of less than about 500 nm and B) PEI wherein the ratio of A:B ranges from about 1:400 to 400:1, respectively. Additionally, as noted above, the composition may further comprise C) an ionic polysaccharide, with the ratio of A to (B plus C) ranging from about 400:1 to about 1:1,000, respectively.

EXAMPLES

The following examples are set forth for purposes of illustration only and are not to be construed as limiting the present invention in any manner. All parts and percentages are by weight unless otherwise specified.

In the examples which follow, the ionic organic polymer microbead and the ionic polymer are added sequentially directly to the stock or just before the stock reaches the headbox.

Drainage is a measure of the time required for a certain volume of water to drain through the paper and is here measured as a 10 × drainage (see, e.g., K. Britt, TAPPI 63(4), 67 (1980).

In all examples, the ionic polymer and the microbead are added separately to the thin stock and subjected to shear. Except when noted, the charged microbead (or bentonire) is added last. Unless noted, the first of the additives was added to the test furnish in a "Vaned Britt Jar" and subjected to 800 rpm stirring for 30 seconds. Any other additives were then added and also subjected to 800 rpm stirring for 30 seconds. The respective measurements were then carried out.

Doses herein are given in pounds/ton for furnish solids such as pulp, fillers etc. Polymers are given on a real basis and starch, clay and bentonire are given on an as is basis.

I. Cationic polymers used in the Examples are:

a) 10 AETMAC/90 AMD: A linear cationic copolymer of 10 mole % of acryloxyethyltrimethylammonium chloride and 90 mole % of acrylamide of 5,000,000 to 10,000,000 molecular weight.

b) 50 EPI/47 DMA 3 EDA: A copolymer of 50 mole % of epichlorohydrin, 47 mole % of diethylamine and 3 mole % of ethylene diamine of 250,000 molecular weight.

II. Ethyleneimine Polymers used in the Examples are:

a) Polymin SK, a modified, high molar mass polyethylenimine (BASF Technical Information, TI/P 2605e October, 1991 (DFC)).

b) Unmodified polyethylenimine (MW=70,000) obtained from PolySciences, Inc.

III. Anionic particles used in the Examples are:

a) Bentonire: Commercially available anionic swelling bentonite from clays such as sepiolite, attapulgite or montmorillonite as described in U.S. Pat. No. 4,305,781.

IV. Microbeads used in the Examples are:

a) 60 AA/40 AMD/2,000 ppm MBA: a microemulsion copolymer of 60 mole % of acrylamide, crosslinked with 2,000 ppm of N,N'-methylene-bisacrylamide (MBA) of 135* nm particle diameter. The SV of this material is about 1.1 mPa.s.

*The particle diameter in nanometers is defined and used herein as that determined by quasielectric light scattering spectroscopy ("QELS") as carried out on the polymer emulsion, microemulsion or dispersion.

The anionic microemulsion is prepared as described in U.S. Pat. No. 4,167,766, the disclosure of which is expressly incorporated herein by reference thereto.

EXAMPLE 1

The following example illustrates the improved drainage, i.e., as evidenced by a reduction in drainage time, obtained by applying the method of the present invention to a waste paper furnish. The furnish is slushed newspaper to which 5% clay (based on fiber content) is added and the pH is adjusted to 7. Drainage is defined as a measure of the time required for a certain volume of water to drain through the paper and is here measured as 10X drainage (see K. Britt, TAPPI 63 (4) p. 67 (1980)).

| Additive(s) | Time Required for 10× Drainage |
|---|---|
| 1) 2 lbs. Polymin SK | 52 seconds |
| 2) 2 lbs. Polymin SK and 5 lbs. Bentonite | 34 seconds |
| 3) 2 lbs. Polymin SK and 0.5 lbs. crosslinked ionic microbeads | 27 seconds |

*The particle diameter in nanometers is defined and used herein as that determined by quasielectric light scattering spectroscopy ("QELS") as carried out on the polymer emulsion, microemulsion or dispersion.

EXAMPLE 2

The following example illustrates the substantial improvement in 10X drainage of a 70/30 hardwood/softwood bleached kraft pulp containing 25% $CaCO_3$ at a pH of 8 upon treatment with the compositions of the invention (i.e, nos. 6–9) compared to conventional additives (i.e., nos. 2–5) and a control (no. 1) with no additive.

| Additive(s) | Time Required for 10× Drainage |
|---|---|
| 1) Blank | 176 seconds |
| 2) 0.6 lbs. 10 AETMAC/90 AMD | 150 seconds |
| 3) 5 lbs. alum, 0.6 lbs. 10 AETMAC/90 AMD and 0.5 lb. crosslinked microbeads | 71 seconds |
| 4) 5 lbs. alum, 1 lb. 10 AETMAC/90 AMD and 0.5 lb. crosslinked microbeads | 55 seconds |
| 5) 5 lbs. alum, 1 lb. 10 AETMAC/90 AMD and 0.75 lb. crosslinked microbeads | 48 seconds |
| 6) 0.5 lb. Polymin SK and 0.5 lb. crosslinked microbeads | 94 seconds |
| 7) 1.0 lb. Polymin SK and 0.5 lb. crosslinked microbeads | 63 seconds |
| 8) 1.5 lbs. Polymin SK and 0.5 lb. crosslinked microbeads | 53 seconds |
| 9) 2.0 lbs. Polymin SK and 0.5 lb. crosslinked microbeads | 42 seconds |

This example additionally illustrates a further advantage to the use of the present method as described above in that 10X drainage values comparable to those obtained with the use of alum can be obtained without it. Moreover, no special make-up equipment is required to produce the compositions added in the process of the present invention.

EXAMPLE 3

An unmodified polyethylenimine (MW approx. 70,000) was added to a waste furnish similar to the furnish treated in Example 1. The 10X drainage results thus obtained are as follows:

| Additive(s) | Time Required for 10× Drainage |
|---|---|
| 1) blank | 127 seconds |
| 2) 1 lb. PEI (MW = 70,000) | 71 seconds |
| 3) 1.5 lbs PEI (MW = 70,000) | 57 seconds |
| 4) 1 lb. PEI (MW = 70,000) 0.5 lbs crosslinked microbeads | 48 seconds |

This example, which compares the results obtained with the use of the compositions of the invention (no. 4) to that obtained with unmodified PEI by itself (nos. 2 and 3) and a control (no. 1), demonstrates that the addition of crosslinked microbeads to unmodified PEI improves the drainage performance of the unmodified PEI.

EXAMPLE 4

In this comparative example, the use of PEI with crosslinked microbeads is compared to such microbeads used with a 50/47/3 epichlorohydrin/dimethylamine/ethylenediamine ("EDE") polyamine polymer. Such use is mentioned in U.S. Pat. No. 5,167,766, Example 12. The results shown below demonstrate improved performance of the PEI/microbead mixture compared to that obtained with the prior art. The test furnish is similar to that used in Example 1.

| | Time Required For 10× Drainage | |
|---|---|---|
| Cationic Polymer | Cationic Polymer Alone | Polymer With 0.56 lb Crosslinked Microbeads |
| 0.5 lb. Polymin SK | 110 seconds | 90 seconds |
| 1 lb. Polymin SK | 78 seconds | 57 seconds |
| 0.5 lb. 50/47/3 EDE polymer | 121 seconds | 103 seconds |
| 1 lb. 50/47/3 EDE polymer | 113 seconds | 91 seconds |

Paper produced by the method described and claimed herein also forms a part of the present invention. That is, the use of the present method results in production of paper having improved "formation" (as defined below) at a lower cost and in a more efficient manner than that available with the use of prior art methods. As used herein, and in the art, the term "formation" refers to the uniformity of the distribution of the mass of paper fibers, filler, etc. throughout the paper sheet. The improvement offered with the use of the method of the invention is evidenced by an ability to increase the speed of the papermaking equipment without a concurrent reduction in the quality of formation of the paper thus in the quality of formation of the paper thus produced, thus permitting one skilled in the art to increase the speed of the operation while concurrently reducing the costs associated therewith.

While it is apparent that the invention herein disclosed is well calculated to fulfill the objectives stated above, it will be appreciated that numerous modifications and embodiments may be devised by those skilled in the art, and it is intended that the appended claims cover all such modifications and embodiments as fall within the true spirit and scope of the present invention.

I claim:

1. A method for making paper which comprises adding to an aqueous paper furnish comprising a plurality of cellulosic fibers: (i) from about 0.05 to about 20 pounds per ton, based upon the dry weight of the fibers, of an anionic, organic crosslinked polymeric microbead having a diameter of less than about 500 nm, and (ii) from about 0.05 to about 20 pounds per ton, same basis, of a polymeric material selected from the group consisting of ethyleneimine polymers, modified polyethylenimines and mixtures thereof.

2. The method of claim 1 wherein the microbeads have a diameter of less than about 500 nm.

3. The method of claim 2 wherein the diameter of said microbeads is between about 25–300 nm.

4. Paper produced by the method of claim 1.

5. The method of claim 1 wherein the microbeads are anionic and the polymeric material is cationic.

6. The method of claim 1 which further comprises additionally adding to said system from about 1.0 to about 50 pounds per ton, based upon the dry weight of said cellulosic fibers, of an organic, ionic polysaccharide.

7. The method of claim 6 wherein said polysaccharide is a starch.

8. The method of claim 6 wherein said polysaccharide has a charge opposite that of said microbead.

9. The method of claim 1 wherein said microbeads have a solution viscosity of from about 1.1 to 2 mPa.S.

10. The method of claim 1 wherein the ratio of the microbeads to the polymeric material ranges from about 1:400 to 400:1 and the polymeric material is a modified polyethylenimine.

* * * * *